US006601570B2

(12) United States Patent
Zetmeir

(10) Patent No.: US 6,601,570 B2
(45) Date of Patent: Aug. 5, 2003

(54) SELF CONTAINED AIR FLOW AND IONIZATION METHOD, APPARATUS AND DESIGN FOR INTERNAL COMBUSTION ENGINES

(75) Inventor: Karl D Zetmeir, Overland Park, KS (US)

(73) Assignee: Karl D. Zetmeir, Overland Park, KS (US)

( * ) Notice: Subject to any disclaimer, the term of this patent is extended or adjusted under 35 U.S.C. 154(b) by 0 days.

(21) Appl. No.: 10/179,932

(22) Filed: Jun. 20, 2002

(65) Prior Publication Data

US 2002/0195089 A1 Dec. 26, 2002

Related U.S. Application Data

(60) Provisional application No. 60/299,806, filed on Jun. 22, 2001.

(51) Int. Cl.[7] ..... F02M 33/00
(52) U.S. Cl. ..... 123/536; 123/539
(58) Field of Search ..... 123/539, 536, 123/538, 590

(56) References Cited

U.S. PATENT DOCUMENTS

| | | | | |
|---|---|---|---|---|
| 1,396,054 A | | 11/1921 | Potter | |
| 1,873,746 A | | 8/1932 | English | |
| 3,893,437 A | * | 7/1975 | Ries et al. | 123/539 |
| 4,515,138 A | | 5/1985 | Agadi | |
| 5,010,869 A | | 4/1991 | Lee | |
| 5,487,874 A | | 1/1996 | Gibboney, Jr. | |
| 5,491,602 A | * | 2/1996 | Horn et al. | 361/228 |
| 5,685,281 A | | 11/1997 | Li | |
| 5,829,419 A | | 11/1998 | Sadkin | |
| 5,947,081 A | | 9/1999 | Kim | |
| 6,041,753 A | | 3/2000 | Lin | |
| 6,158,412 A | | 12/2000 | Kim | |

OTHER PUBLICATIONS

Federal Trade Commission, Facts for Consumers, Gas–Saving Facts or Fuelishness?, Internet, ftc.gov, U.S.

Argonne National Laboratory, Technology Trasfer at Argonne, Clean–Diesel Breakthrough, Internet, anl.gov, U.S.

Compact Membrane Systems, Combustion Engine Applications, Internet, compactmemebrane.com, U.S.

Kockelman and Zhao, Behavioral Distinctions: The Use of Light–Duty Trucks and Passenger Cars, p. 1, Internet, bts.gov, U.S.

Jones, Thomas B., Ph.D., Electrophorus and Accessories, demos, Internet, ee.rochester.edu, U.S.

TPL Inc., Dielectric Powders, Nano–sized Ceramic Powders, Internet, tplinc.com, U.S.

Eguchi, Mototaro, Ph.D., On the Permanent Electret, Philosophical Magazine, vol. 49, 1925, pp178, Japan.

Potter, Paul E, The Vortex, Internet, U.S.

Koehler, Kenneth R, Ph.D., College Physics for Students of Biology and Chemistry, Coulomb Force, 1996, Internet, rwc.uc.edu, U.S.

De Queiroz, Antonio Carlos, Prof., Electrostatic Machines, Internet, coe.ufrj.br, Brazil.

Moin, Parviz, Ph.D., Tackling Turbulence with Supercomputers, Scientific American, Jan., 1997, U.S.

Boomer, Preston, Electrostatics, Modern Physics, 1984, Chap. 16, Williams, Trinklein, Metcalfe. Holt, Rinehart and Winston, U.S.

* cited by examiner

*Primary Examiner*—Marguerite McMahon

(57) ABSTRACT

This invention method combines numerous disciplines to enhance the performance of internal combustion engines. No prior art embodies the discipline of physics in the creation of a swirling vortex, principles of electrostatics in using tribology and coulomb forces, the utilization of dielectric properties of polymers in an air driven rotating electrophorus and the chemistry of enhanced combustion gases and combustion itself in a single self-contained apparatus and does so without the convention and application of external voltage.

15 Claims, 1 Drawing Sheet

SELF CONTAINED AIR FLOW AND IONIZATION APPARATUS FOR INTERNAL COMBUSTION ENGINES

SELF CONTAINED AIR FLOW AND IONIZATION METHOD, APPARATUS AND DESIGN FOR INTERNAL COMBUSTION ENGINES

CROSS REFERENCE TO RELATED APPLICATIONS

Provisional Application 60/299,806, Jun. 22, 2001.

STATEMENT REGARDING FEDERAL SPONSORSHIP

No Federally Sponsored Research or Development is involved.

BACKGROUND OF THE INVENTION

1. Field of the Invention

This invention relates to an air ionization method, apparatus and design. The invention specifically relates to a method of supplying charged air to spark ignition or diesel internal combustion engines (ICE).

2. Discussion of Background

Many vehicle owners in the U.S. and globally depend upon motorized vehicles for everyday transportation. Vehicles are an integral part of everyone's lives and motorists are concerned with the availability of fossil fuels to power their vehicles, the economics of fueling vehicles, dependence upon foreign suppliers for oil and retaining the size and power of vehicles they are accustomed to for transportation and occupational related needs.

Heretofore many solutions have been proposed and some marketed to enhance internal combustion through various air ionization generators and devices to swirl air entering induction manifolds or cylinders. Air ionization apparatus have relied on known technology of applying an external voltage to two electrodes, creating a discharge between them and passing air through the spark thereby exciting the molecules of air such that they collide, split and produce negative and positive ions. Air swirl devices rely on air deflection vanes to create turbulent air flow to push more air into combustion cylinders.

These devices have numerous variations, most of which are effective in producing air ionization or swirling air. However, few have had significant commercial success due to difficulty of installation, requirements for engine-specific fit or failure to provide measurable benefits to consumers. In fact, the Federal Trade Commission has been unable to find any measurable benefit from devices they have tested.[1]

Atmospheric conditioning devices have not been tested by the FTC as none have achieved commercial success in the consumer marketplace. However, Argonne National Laboratories[2] in conjunction with Compact Membrane Systems[3] have demonstrated it is possible to use atmospheric conditioning to achieve significant improvements in ICE performance.

Inherent in existing ionization technology is creating a spark between electrodes powered by an external voltage source. While original equipment manufacturers (OEM) could design such capability into their vehicles, they have chosen not to do so. Further, OEM have not allowed for such capability within the electrical systems of vehicles manufactured in past years. Consequently, installation of air ionization devices requiring an external voltage source is impossible or very difficult for motorists to install in their current vehicles.

Currently there are over 200 million vehicles in the U.S.[4] Fully 50% of those vehicles are classified as "gas guzzlers" including SUVs, trucks and large engine automobiles. While a huge research and development effort is taking place in the area of hydrogen fuel cells and other alternative energy sources, dependence on fossil fuels will continue to be with us many years due to massive numbers of ICE currently in use and continuing ICE production as other methods of vehicular power are phased into the marketplace.

Most vehicle owners, therefore, would find ICE enhancement devices desirable that are relatively inexpensive, simple to install with common tools into their current vehicles, require no external voltage source, require no user maintenance and provide significant performance benefits for vehicular applications. Benefits of this preferred embodiment include increased mileage, more power and reduced emissions when used in conjunction with internal combustion engines.

Other inventors have developed various apparatus intended to swirl inducted air thus increasing the amount of air available for combustion, increased fuel droplet atomization and evaporation to provide benefits of better mileage, more horsepower, cleaner combustion and reduced exhaust emissions. These devices have met with modest consumer acceptance and little scientific acclaim.

PRIOR ART

Prior art is replete with static electricity inventions.[10] Prior art is also replete with inventions designed to increase the efficiency of internal combustion engines. Many of these inventions have focused on techniques designed to improve the mixing of air and fuel using swirling air as a means to enhance efficiency through a combination of further atomization, nebulization of fuel droplets and more rapid evaporation.

Moin and Kim stated in a Scientific American article:[11]

> "Turbulence, however, is not simply an unfortunate phenomenon to be eliminated at every opportunity. Far from it: many engineers work hard trying to increase it. In the cylinders of an internal-combustion engine, for example, turbulence enhances the mixing of fuel and oxidizer and produces cleaner, more efficient combustion."

Many methods and apparatus to create turbulence external to combustion cylinders have been invented since 1932. In U.S. Pat. No. 6,041,753, Lin and Yang with Assignees of China Motor Company and others, clearly demonstrate performance benefits of swirling air in a Multi Port Fuel Injection engine. In U.S. Pat. No. 5,947,081, Kim discloses an air swirl system suitable for:

> "spark ignition internal combustion engine of the carburetor type or of the fuel injection type, as well as a diesel engine of the high compression, self-ignition type."

Other examples of inventions to swirl air to enhance combustion are found in: U.S. Pat. No. 1,396,154; U.S. Pat. No. 4,515,138; U.S. Pat. No. 5,685,281, U.S. Pat. No. 6,158,412; and U.S. Pat. No. 6,041,753. The disclosures of these patents are incorporated herein by reference.

The above references include methods and apparatus solely designed to swirl air. No additional conditioning or enhancement of air chemistry is mentioned. This preferred embodiment not only incorporates a static vortex generator as a turbulence device to enhance combustion but also uses the resulting vortex to deliver reactive ionized air pneumatically to a combustion environment within the cylinders.

Prior art is replete with numerous patents to enhance combustion gases. In U.S. Pat. No. 5,010,869, Lee discloses one benefit of introducing ionization byproducts into the combustion process:

"Furthermore, electrically charged liquid fuel droplets resist coalescing into larger droplets, thereby permitting the fuel to be mixed more thoroughly with the air"

In U.S. Pat. No. 5,487,874, Gibboney discloses:

"Upon exiting the ion generator, the charged molecules are mixed with air or other combustion gas supplied to the engine. The charged molecules produce a denser, oxygen-enriched air charge, resulting in longer and hotter burns, creating more torque and horsepower for the same percentage of throttle."

Addressing air velocity, Gibboney also discloses the ionization of air affects the amount and quality of air:

Automobiles run better after a thunderstorm. This phenomenon is primarily caused by the natural conditions that exist after an electrical storm, namely, the presence of ozone and an increase in the relative amount of negative ions in the air. These conditions increase the efficiency of the internal combustion process by correcting conditions in the engine that decrease efficiency: first, an air charge that has more negative ions is denser than an air charge with a higher positive:negative ion ratio. (The term "air charge" refers to the quantity of air supplied to the cylinder during a single cycle.) Second, an air charge that is rich in negative ions generates a greater forward velocity because the negative ions are attracted to the positive ionic charge that exists in a cylinder after the previous bum, thus increasing the amount of air that enters the cylinder, the bum time and temperature. Third, ozone (O.sub.3) contains more oxygen than diatomic oxygen (O.sub.2). The combination of a denser air charge and more oxygen, coupled with increased bum time and temperature, increases the cylinder pressure, which increases the engine torque and horsepower output. By increasing the engine's ability to do work, less fuel is used to perform the same work as an engine in a normal situation.

The disclosures of these patents are incorporated herein by reference.

When ionization occurs in this embodiment, negative and positive ions and ozone are created. Ionized air is entered directly into the center of the vortex. Air is moving between 50 and 100 mph in an ICE so the time for the ionized air to move from the device to the combustion area is very fast. During that time, positive ions are attracted to the negative ions and to the grounding of the engine (opposite charges attract) and are instantly neutralized. Some Ozone (O.sub.3) is heavy and caught in the vortex spin and neutralized when in contact with engine parts. Negative ions are repelled by the negative grounding (like charges repel) and have a higher survivorship in passing into the combustion area where they instantaneously combine with atomized fuel particles and the positive charge left after the previous combustion. Ionization thusly makes the air "slick," reducing drag and permitting larger amounts of air to enter the combustion chambers and creates a more efficient combustion environment within cylinders.

Other References

See Information Disclosure Statement and enclosed reprints.

BRIEF SUMMARY OF THE INVENTION

This invention uses a combination of both air turbulence and ionization through the combination of physics, electrostatics[12] and chemistry in a novel method and apparatus.

The problems with prior art air ionization systems for internal combustion engines and other applications have been the requirement of an external voltage source to power ionization. This requirement makes retrofitting of such systems extremely difficult for vehicles already manufactured and in use. Few aftermarket vehicle owners are likely to attempt installing devices requiring hard wiring to the existing vehicle's electrical system. No prior art inventions have specifically integrated air turbulence with air ionization.

This embodiment uses the dielectric properties of polymers configured as a rotary electrophorus such that no external power source is required other than air velocity created by an ICE to ionize air. Consequently, the apparatus can be installed into virtually any vehicle or other ICE configuration with little more than common tools such as scissors and screwdriver. The ease of installation is well within the means of average consumers.

The charged molecules and negative ions produce denser, oxygen-enriched air charge, higher intake air velocity and turbulence, resulting in longer and hotter burns, creating more torque and horsepower for the same percentage of throttle.

Other features and advantages of the present invention will be apparent to those skilled in the art from a careful reading of the Detailed Description of a Preferred Embodiment presented herein and accompanied by the drawing.

DETAILED DESCRIPTION OF INVENTION

Figure 1:
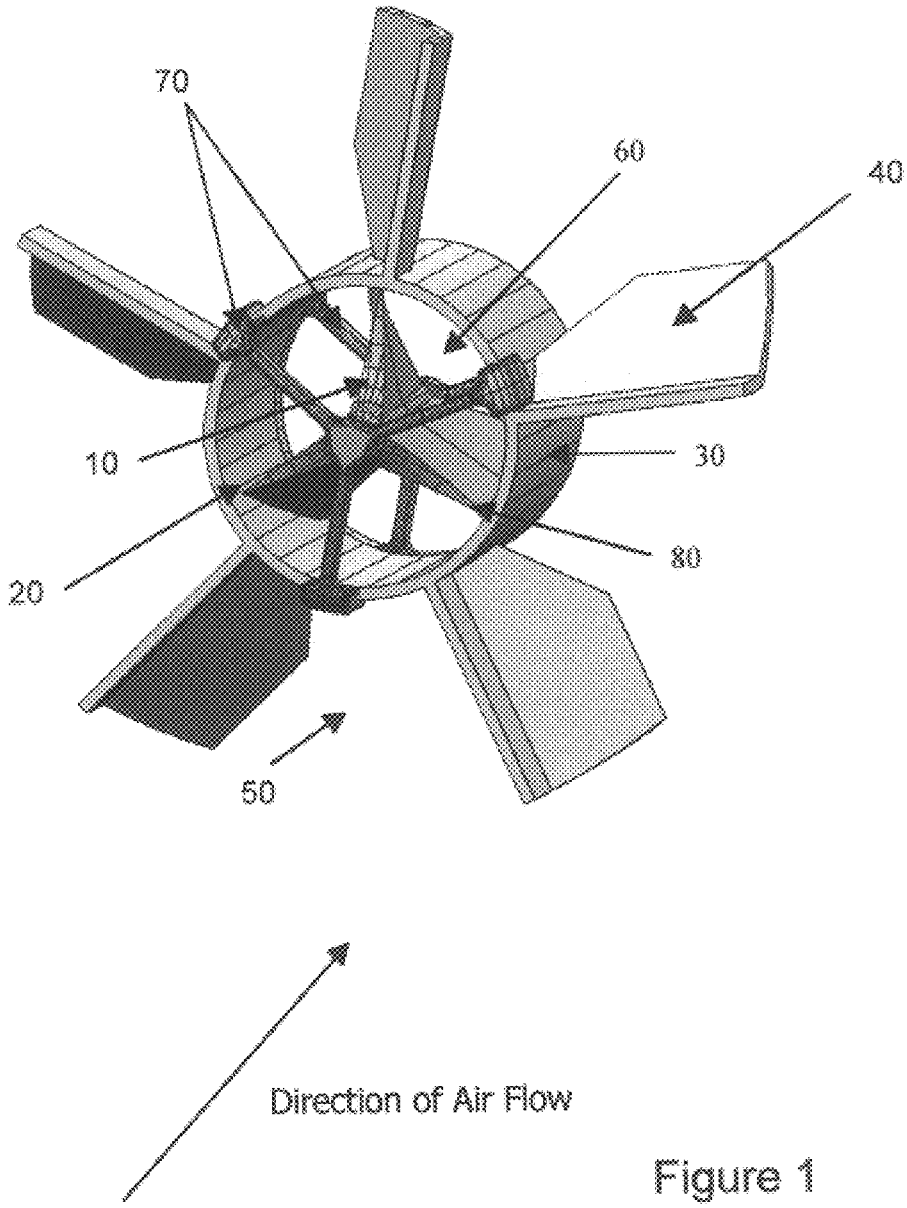
FIG. 1 is an isometric view of the apparatus.

Dielectric values of materials are measurements of their permitivities. Permitivity is a material's ability to give off either negative or positive charges. Devices that use tribological configurations of varying dielectric materials to create static charges are defined as electrophorus.[5] The basics of creating electrophorus are well known. High school students are shown manually rubbing fur against a nylon comb creates enough static charge to pick up a tissue.

A variety of materials can be used to create electrophorus including various polymers, metals and ceramics. This embodiment preferably uses two state of the art polymers, one in the stator and one in the rotor, such as polyimides or nylon, doping one polymer to raise the dielectric constant value to greater than 10.0. Several materials can be added to raise the dielectric value of polymers while retaining the physical properties of the polymer base. This preferred embodiment uses nano-sized particles of Barium Titanate, a ceramic powder to create a high dielectric constant polymer used in the rotor.[6] Other materials such as Titanium or Strontium derivatives will also elevate the dielectric value of polymers significantly. There is a linear relationship between the amount of high dielectric additives added to a polymer and percentage the dielectric constant is increased.

The method of controlling the frequency and strength of static charge produced is by optimizing the speed of the air flow passing through the apparatus, the pitch of the spiral vanes on the rotor 10, the size of the air gap 20 between the rotor and stator 30, the dielectric strengths of the polymers and the relative variance of dielectric constants between the two polymer parts. The pitch of the vanes on the rotor 10 may change to control rotor RPM based upon the demands of a specific ICE. Additionally, fluting or rifling may be added to the stator wall to provide a relaxation of the charge created before the next charge begins.

Alternatively, naturally high dielectric value materials may be used. Some dipole polymers require polarization in their manufacture to lock the dielectric values to avoid neutralization with time and temperature.[7]

The second polymer used in the preferred embodiment's stator is the other half of the electrophorus and has a low dielectric constant, typically less than 5.0. Such polymers include PVC, PET, nylon or other polyester composites. A wide variation of relative rotor and stator dielectric constant differentials of at least two to one is preferable to efficiently create a dielectric barrier discharge when moving in opposition relative to one another at varying air flow velocity constantly changing with ICE RPM.

This preferred embodiment typically is mounted into a pre-existing air flue between an air cleaner and the air intake manifold in an ICE although other locations such as preceding the air cleaner are possible. In this preferred embodiment, air is moved through a turbine rotor 10 with a plurality of vanes made of a high dielectric polymer mounted within a stator housing 30 made of low dielectric polymer, thus creating an air-driven electrophorus. A small portion of the air moving through the electrophorus is ionized producing anions, cations and ozone. Members 70 molded to the stator housing or separate structures affixed by clips or sonic welding support the rotor. The rotor and stator parts may be either machined or injection molded.

The stator housing 30 incorporates a static vortex generator by integrating air deflection vanes 40 on the exterior of the stator housing. These vanes also serve to anchor the apparatus inside air flues of differing shapes and sizes by trimming the vanes to create a compression fit against the interior of the existing air flue. Consumers may choose to cement the vanes against the inside of their air flue using commercially available adhesives. A vortex is a rapidly moving central column of air with slower deflected air moving generally counterclockwise around the periphery of the central column of air.[8] Air moving through the external zone 50 is redirected by the static deflector vanes to surround the column of air moving through the internal zone 60 thus forming a vortex.

Air velocity is powered by an ICE. A vortex is formed as the air flow passes through the apparatus and the air flow is deflected by the air vanes. Additionally, the rotor 10 spins inside the stator housing 30 driven solely by air flow from the ICE. The rotor and stator are made of different materials with the dielectric property of each at wide variance to the other. The rotor and stator may be in contact with one another or in the preferred embodiment, a small air gap 20, typically less than a millimeter is maintained between the rotor and stator and an electrostatic dielectric barrier discharge is created as the rotor turns. The force of this discharge is determined by Coulomb's Law.[9] This static discharge excites air molecules passing through the air gap 20 to the point of collision with one another. This collision creates plasma within the stator housing 30 and protruding past the apparatus depending on the air velocity passing through the apparatus with positive and negative oxygen ions, ozone and oxygen resulting. To focus the energy between the rotor and stator, the edges 80 of the rotor vanes are beveled to a fine edge or alternatively may be saw-toothed to create a plurality of discharge points.

Another embodiment could eliminate the rotor with a grid or coating of the apparatus with high dielectric material and rely strictly upon air friction across the material to create the ionization.

This apparatus does not require an external voltage source to produce air ionization. Rather, the energy present in an air stream turns the rotor creating an electrostatic discharge within the air gap to the stator. This discharge ionizes air and the vortex air stream conveys the ionized air to combustion cylinders. The creation of a vortex is essential to pneumatically deliver the plasma generated ionization to the cylinders with a maximum survival rate of the negative oxygen ions. The preferred embodiment is described with an ICE application, however similar methodologies of creating a electrophorus using polymers to create ozone and charged ions could apply to other applications, such as air purification, fluid purification or manufacturing processes requiring static charge and ionization in the absence of an external high voltage source.

What I claim as my invention is:

1. An apparatus for generating ionized air comprising:

A stator housing;

Said stator housing having a support structure to suspend a rotor inside the housing;

A rotor;

means to ionize air with positive and negative ions, ozone and oxygen resulting;

Means to swirl air into a vortex, increasing air volume and velocity to combustion cylinders and delivering charged ions with the highest possible survivorship of negative ions.

2. The apparatus described in claim 1, wherein said device is used in conjunction with internal combustion engines.

3. The apparatus described in claim 1, wherein said device is used in air purification.

4. The apparatus described in claim 1, wherein said device is used in manufacturing processes requiring ionization.

5. The apparatus described in claim 1, wherein said device is used in fluid transport systems to ionize the fluids.

6. The apparatus described in claim 1, wherein the stator housing is made from a polymer with a dielectric constant of less than 5.0 (ASTM);

wherein said stator housing has a plurality of vane members extending radially outward from the central stator housing.

7. The apparatus described in claim 1, wherein the rotor is shaped like a turbine;

wherein the rotor is made from a polymer with a dielectric constant not less than 10.0 (ASTM) achieved naturally or by the addition of high dielectric additives;

wherein the rotor contains a plurality of vanes extending outward from a central axis, each spiraling around the circumference of the axis in whole or in part and extending for the length of the rotor, each vane with beveled edges;

wherein said rotor is able to turn in close proximity to the inside surface of the stator housing.

8. The apparatus as recited in claim 1, wherein the device is divided into two zones further comprising of:

An external zone area between the stator housing and a pre-existing air flue;

wherein said external zone contains a plurality of air deflection vanes protruding from the stator housing;

means for the apparatus to be held stationary through compression of the air deflection vanes against a pre-existing flue;

An internal zone consisting of the area inside the stator housing;

wherein said internal zone contains rotor supports at the top and bottom with indentations to contain the rotor axle on center;

wherein said internal zone contains a rotor;

means for the rotor to spin in the presence of an externally supplied air flow.

9. An electrophorus apparatus controllable by design and selection of polymer materials to the amount and strength of the dielectric barrier discharge consisting of:

means for creating an electrophorus as described in claim 1 using varying dielectric constant polymers;

means for controlling the relative dielectric differentials between two polymers by doping one polymer with high dielectric constant additives;

means for controlling the capacitance of the static discharge by selecting polymers with specific dielectric strengths;

means for controlling the amount of static charge and rotor RPM by determining the pitch of the spiral vanes on rotor;

means for controlling the contact points between the rotor and stator by the shape of the edges on the vanes of the rotor, said points varying from one to a plurality of points;

means for controlling the coulomb force of the static charge by controlling the size of the air gap between the rotor and stator from zero to a gap greater than zero;

means for creating a vortex using deflection vanes on the stator housing;

means for increasing air velocity and volume available to an ICE using said vortex;

means for transporting generated ionized air pneumatically through a pre-existing air flue that contains the vortex;

means for maximizing utility in a plurality of flue designs by modifying the fit of the apparatus to pre-existing flues by trimming the ends of the deflector vanes.

10. Apparatus for generating ionized air, said apparatus using high and low dielectric constant materials in an electrophorus consisting of:

A rotor and stator manufactured to obtain final shape and form;

said rotor is made from material selected from polymer that has been formulated for a high dielectric constant value;

said rotor constructed from a high dielectric constant polymer doped with additives to elevate the dielectric constant to not less than 10.0 (ASTM);

a stator constructed from polymer with a low dielectric constant value of less than 5.0 (ASTM);

wherein the difference in relative dielectric constants between the stator and rotor polymers with the higher constant polymer is not less than two times the constant of the lower polymer.

11. The apparatus described in claim 10, wherein manufacture of rotor and stator means to create through injection molding.

12. The apparatus described in claim 10, wherein manufacture of rotor and stator means to create through machining the parts on mechanical tools.

13. The apparatus described in claim 10, wherein doping with additives means adding barium titanate to the polymer to elevate the dielectric constant of the polymer.

14. The apparatus described in claim 10, wherein doping with additives means adding ceramic powder to the polymer to elevate the dielectric constant of the polymer.

15. The process using the apparatus as recited in claim 10, comprising the steps of:

Having a means of creating ionized air by the method of forming a dielectric barrier discharge in the presence of an externally powered air flow passing through the discharge created within an electrophorus;

Having a means for the rotor to spin inside the stator;

Having a means for the interaction of the rotor and stator to create an electrophorus;

Having a means for a dielectric barrier discharge to be created in the air gap between the rotor and stator;

Having a means for air molecules passing through the dielectric barrier discharge to be accelerated, forming a plasma;

Having a means for plasma species to be pneumatically transported.

* * * * *